US006481766B1

(12) United States Patent
May et al.

(10) Patent No.: US 6,481,766 B1
(45) Date of Patent: Nov. 19, 2002

(54) GLOVE-LIKE DISPOSAL BAG

(76) Inventors: Robert Carl May, 1584 Bellmonte Rd., Pittsburgh, PA (US) 15237; Christopher S. Ayers, 702 SE. 2nd Ave. #407, Deerfield Beach, FL (US) 33441

( * ) Notice: Subject to any disclaimer, the term of this patent is extended or adjusted under 35 U.S.C. 154(b) by 0 days.

(21) Appl. No.: 10/002,081

(22) Filed: Nov. 1, 2001

(51) Int. Cl.[7] ..... A01K 29/00; A41D 19/00

(52) U.S. Cl. ..... 294/1.3; 294/25; 2/160; 15/227

(58) Field of Search ..... 294/1.3–1.5, 25; 2/16, 20, 158–160, 161.6, 161.7, 168; 15/227; 383/4

(56) References Cited

U.S. PATENT DOCUMENTS

| | | | | | |
|---|---|---|---|---|---|
| 2,745,128 | A | * | 5/1956 | Zeuner | 15/227 |
| 4,645,251 | A | | 2/1987 | Jacobs | |
| 4,677,697 | A | | 7/1987 | Hayes | |
| 4,788,733 | A | | 12/1988 | Lerner | |
| 4,959,881 | A | | 10/1990 | Murray | |
| 5,301,806 | A | | 4/1994 | Olson | |
| 5,318,334 | A | | 6/1994 | Madrid | |
| 5,438,708 | A | | 8/1995 | Jacovitz | |
| 5,564,154 | A | * | 10/1996 | Cohn, III | 15/227 |
| 5,704,670 | A | | 1/1998 | Surplus | |
| 6,116,668 | A | | 9/2000 | Carpool | |
| 6,351,867 | B1 | * | 3/2002 | Forster | 15/121 |

* cited by examiner

*Primary Examiner*—Dean J. Kramer
(74) *Attorney, Agent, or Firm*—McKay & Associates, PC

(57) ABSTRACT

A glove-like bag of a sturdy, pliable plastic or rubber material for the collection and disposal of waste material includes a major body portion conformable to and capable of receiving therein an individual's hand, and a thumb portion laterally extending from the major body portion for receiving the individual's thumb. A flexible offset bag portion is attached to the major body portion and the thumb portion, which can be torn away for disposal of the waste material. The glove-like bag also includes a cleaning pad for both wiping the surface after the waste material has been collected and for limiting abrasion to the glove-like bag during wiping. A sanitizing bar is attached to the major body portion adjacent the cleaning pad for sanitizing the surface after the waste material has been removed therefrom.

18 Claims, 4 Drawing Sheets

GLOVE-LIKE DISPOSAL BAG

BACKGROUND OF THE INVENTION

The present invention pertains to waste collection and disposal systems and devices, and, more particularly, pertains to a glove-like bag for manually collecting and disposing of waste material.

With the modern emphasis on health, hygiene, sanitation and cleanliness in both public and personal spheres, it is a priority to have readily available waste material collection, clean up, and disposal systems and devices.

This is especially the case for individuals in situations where waste material must be quickly and efficiently collected and disposed of in order to maintain a clean, safe, and sanitary environment. Moreover, there are a number of situations and places where it is mandatory that any spillage or deposition of waste material be immediately collected and disposed of for reasons of public and personal hygiene and health. Such situations include the spillage of food product and garbage in restaurants, the leakage of fecal matter when changing a baby's diaper, and the defecation of pets, especially dogs, when they are being walked in parks and in other public grounds. In the aforementioned examples, the waste material must be quickly collected by an individual for disposal while at the same time the individual attempts to minimize—and preferably avoid—any contact with the waste material. This is notably difficult to achieve in the case of mother changing her infant's diaper where one hand is required to hold the infant relatively still while the other hand is needed for removing the diaper, cleaning the infant, and then putting on a clean, new diaper.

In order to meet such situations, various waste collection and disposal systems and devices have been conceived ranging from dispensable towelettes for cleaning infants to hand manipulable scoopers attached to elongated handles for collecting animal waste. Towelettes have the disadvantage in that they can't prevent the individual's hands from being soiled while the disadvantage of scoopers is that they must be cleaned after each use to avoid the accumulation of filth and foul smelling odors. If scoopers can't be easily cleaned, then they must be wrapped in newspaper or some other material to prevent the car or mini van floor from being marred.

In view of the above difficulties in dealing with waste material, the prior art discloses a number of devices ostensibly directed to improvements in waste material collection and disposal.

For example, Jacob's (U.S. Pat. No. 4,645,251) discloses a glove-like waste disposal system that includes an inner glove and an outer glove that fits over the inner glove so that the individual can pick up the waste material in the palm of the outer glove. Both gloves are then everted for disposal of the waste material.

Hayes (U.S. Pat. No. 4,677,697) discloses disposable clean-up bags that are dispensed from a container in sheets one after the other.

Lerner (U.S. Pat. No. 4,788,733) discloses a glove that may be imbued with a cleaning solution and which is turned inside out for disposing of a soiled baby diaper.

Murray (U.S. Pat. No. 4,959,881) discloses a cleaning mitt having various compartments, and a concealed cleaning pad, for cleaning and disinfecting surfaces.

Olson (U.S. Pat. No. 5,301,806) discloses a clean up bag having a glove affixed to the interior of the clean up bag and which is removable for cleaning up waste material.

Madrid (U.S. Pat. No. 5,318,334) discloses a bag blank that can be reconfigured to form a bag that can hold waste material.

Jacovitz (U.S. Pat. No. 5,438,708) discloses a glove that includes handles that are used to turn the glove inside out after waste material has been collected in the palm of the glove.

Surplus (U.S. Pat. No. 5,704,670) discloses a glove bag having fingers and a cuff portion that has compartments for holding objects.

Carpol (U.S.,Pat. No. 6,116,668) discloses a flexible garment having fingers for grasping solid animal waste in the palm of the garment which is then everted for disposing of the waste material and the garment.

Nonetheless, despite the variety of waste disposal systems and devices there remains a need for one that is simple and efficient to use and that prevents any skin contact with the waste material.

SUMMARY OF THE INVENTION

The present invention comprehends a glove-like bag for waste material collection and disposal, and the glove-like bag can be disposed of along with the waste material or it can be reused after the waste material has been disposed.

The glove-like bag of the present invention includes a major body portion configured for accommodating a human hand. Integrally attached to the major body portion is a wrist portion through which the individual inserts his or her hand for placement within the major body portion. The major body portion also includes a thumb portion that extends laterally from the major body portion and which is sized to accommodate therein the individual's thumb. Extending between the major body portion and the thumb portion is an offset bag portion that can be manipulated to contact and collect the waste material therein. In addition, the major body portion can have attached or formed thereon a cleaning pad to protect the major body portion from abrasion during waste material collection and to scrape the surface after the waste material has been removed therefrom; and a sanitizing bar for sanitizing the surface after collection of the waste material.

In an alternate embodiment, the major body portion is divided to form two finger sections or portions and the cleaning pad wraps around the finger section that accommodates the individual's little finger and ring finger. Also, the sanitizing bar extends along the outer edge of the finger section that encloses therein the individual's little finger and ring finger. The sanitizing bar is protected by a peel-away strip that must be first removed in order to release the sanitizing agent or substance.

It is an objective of the present invention to provide a glove-like bag that allows for waste material collection and prevents any skin contact by the waste material during collection and disposal.

It is another objective of the present invention to provide a glove-like bag having a removable offset bag portion wherein waste material can be collected so that the offset bag portion can be removed with the waste material gathered therein thus allowing reuse of the glove-like bag.

Yet another objective of the present invention is to provide a glove-like bag having both a cleaning pad and a sanitizing bar for both scraping the waste material off the surface and then deodorizing and sanitizing the surface after removal of the waste material.

The above and other features and advantages of the present invention will become apparent from the following description when read in conjunction with the accompanying drawings, wherein like reference numerals denote the same elements.

DETAILED DESCRIPTION OF THE PREFERRED EMBODIMENT

Illustrated in FIGS. 1–6 is a preferred embodiment for a glove-like disposal bag 10 for collecting and containing waste material 12 therein so that the waste material 12 can be properly disposed. The glove-like disposal bag 10 of the present invention is a lightweight, durable, sturdy item that can be easily and quickly placed on an individual's hand 14 and removed therefrom. The glove-like bag 10 can be manufactured from a plastic or rubber material; although latex rubber is the preferred material. The glove-like bag 10 can be used for the collection and disposal of a wide variety of waste material ranging from kitchen and restaurant refuse to infant and toddler waste to animal leavings; and perhaps the most efficacious use of the glove-like bag 10 is for collecting and disposing of animal defecation during walks in parks and along roadways and housing plan streets.

Figure 1:
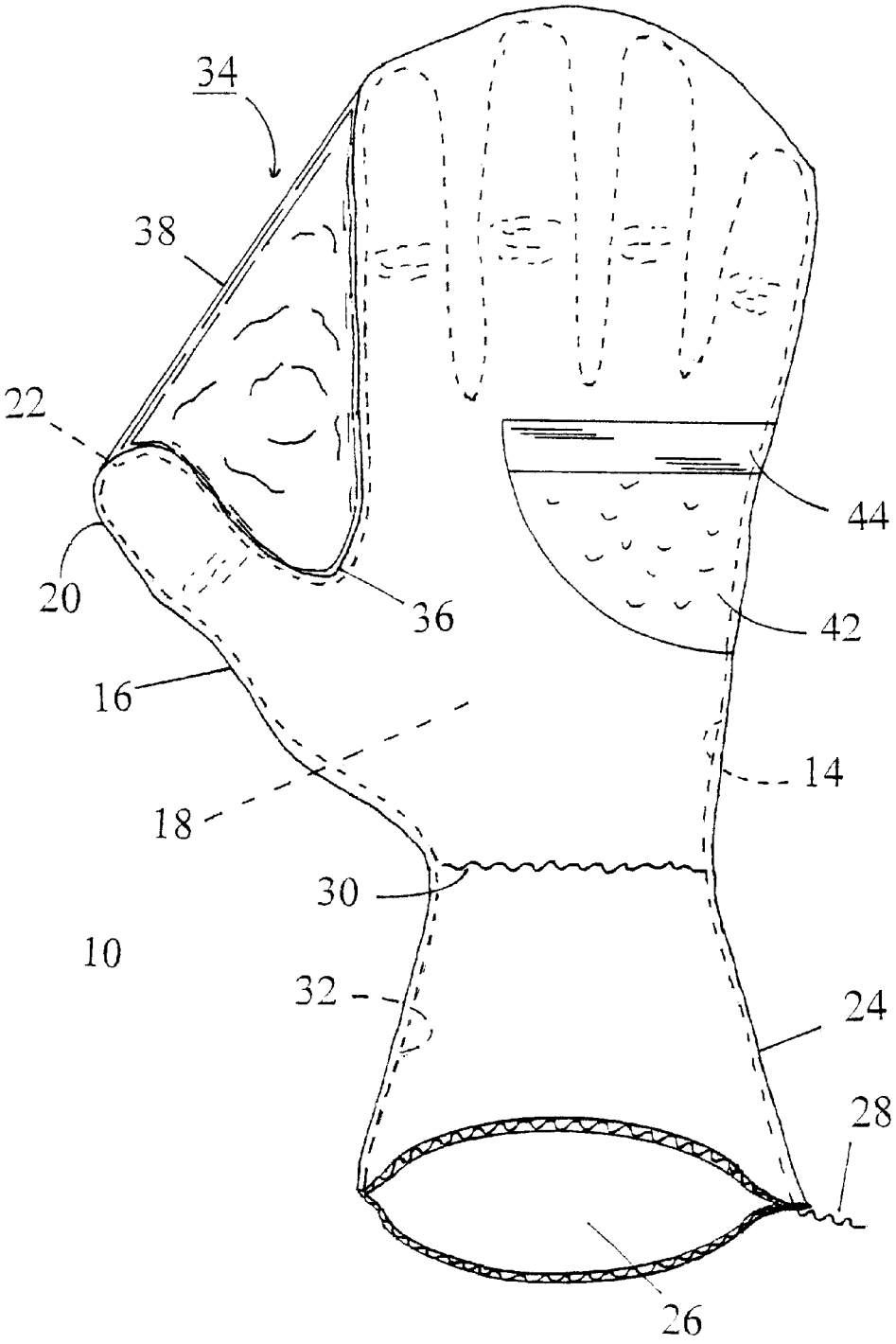
FIG. 1 is a perspective view of the glove-like disposal bag of the present invention showing the primary structural elements including the major body portion and the offset bag portion.

As shown in FIGS. 1–6, the glove-like disposal bag 10 of the preferred embodiment includes a major body portion 16 that is sized to fully enclose and comfortably accommodate therein the individual's hand 14. The major body portion 16 includes an interior cavity 18 into which the individual's hand 14 is fully inserted. A thumb portion 20 extends laterally from the major body portion 16 and registers with the interior cavity 18 for receiving therein the individuals thumb 22. Integrally formed to the major body portion 16 and communicating with the interior cavity 18 is a wrist portion 24 that is slightly flared to allow easy insertion by the individual's hand 14. Specifically, as shown in FIG. 1, the wrist portion 24 includes a hand opening 26 that registers with the interior cavity 18 and through which the individual slides his or her hand 14 for placing it inside the glove-like bag 10. The glove-like bag 10 is ambidextrous in the sense that it can be worn by both left-handed and right-handed individuals, and the flared wrist portion 24 facilitates the eversion of the entire glove-like bag 10 after the waste material 12 has been collected.

As illustrated in FIGS. 1 and 4–6, the glove-like bag 10 includes several additional structural elements to maintain the glove-like bag 10 on the individual's hand 14. Attached to or partially embedded within the annular hand opening 26 is a flexible and adjustable drawstring 28 that can be easily tightened by pulling on the free end of the drawstring 28. Also, the area of attachment between the wrist portion 24 and the major body portion 16 is defined by an annular cinched portion 30 that serves as a constriction around the individual's wrist 32, and cinched portion 30 assists in holding the glove-like bag 10 on the individual's hand 14.

Illustrated in FIGS. 1–6 is the structural element that actually contacts and collects therein the waste material 12, and because of its position on the glove-like bag 10, and its shape and characteristics, avoids and negates the unpleasant feel of waste material 12 being held in the palm of the individual's hand 14. More specifically, the element that contacts and collects therein the waste material 12 is an offset bag portion 34 that is integrally attached to the major body portion 18 and extends between the thumb portion 20 and the major body portion 18. The offset bag portion 34 is composed of the same material as the other elements of the glove-like bag 10, and is pliable and manipulable to allow the individual to collect the waste material 12 therein. The offset bag portion 34 can flex so that it can be maneuvered by the individual for contacting and then collecting therein the waste material 12. The offset bag portion 34 has a depth of at least 2 or 3 inches, preferably 5 or 6 inches, for providing sufficient surface area to hold the waste material 12 and maintain the distance of the waste material 12 from the palm of the individual's hand 14.

Figure 2:
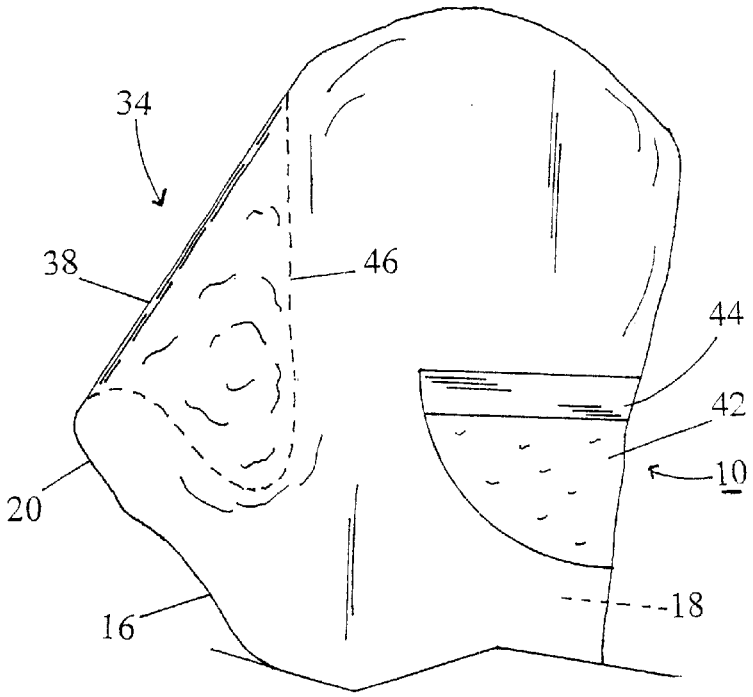
FIG. 2 is a rear elevational view of the glove-like disposal bag first shown in FIG. 1 illustrating the cleaning pad and the sanitizing bar.
Figure 3:
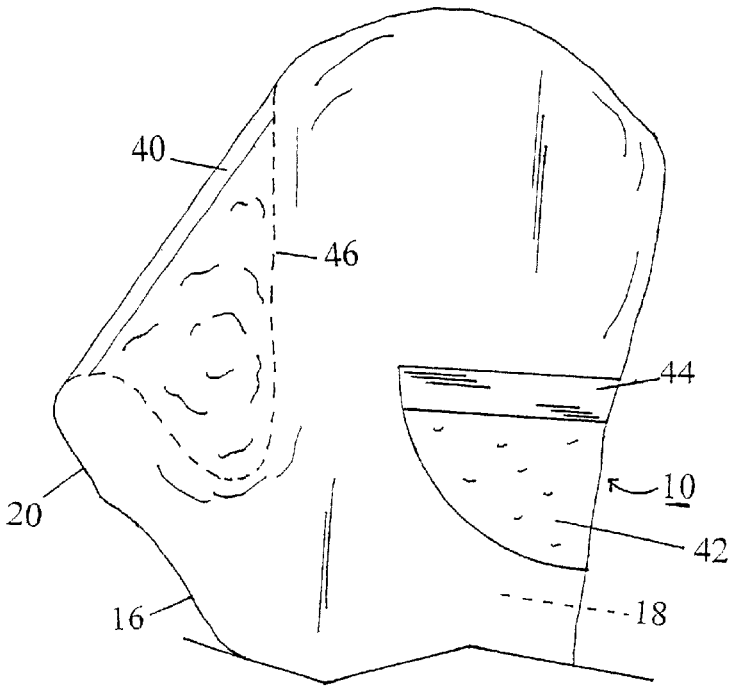
FIG. 3 is a rear elevational view of the glove-like disposal bag first shown in FIG. 1 illustrating a perforation-type attachment of the offset bag portion to the major body portion and a reinforcement strip attached to the outer edge of the offset bag portion.
Figure 4:
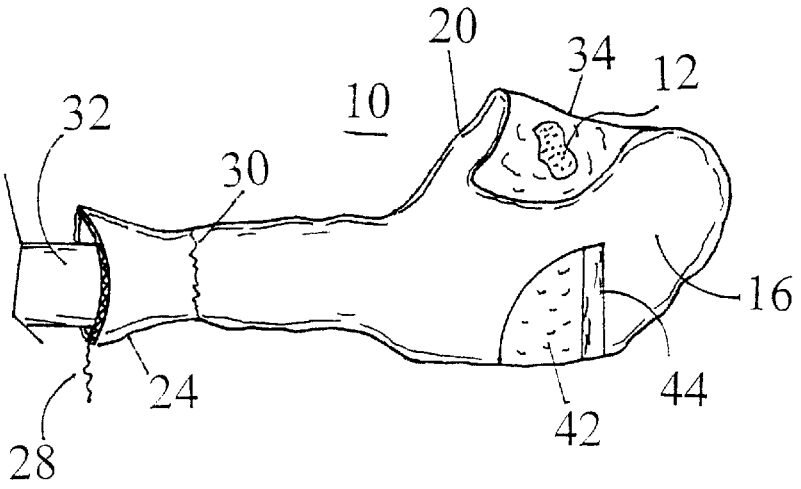
FIG. 4 is a perspective view of the glove-like disposal bag first shown in FIG. 1 illustrating the collection of waste material in the offset bag portion.
Figure 5:
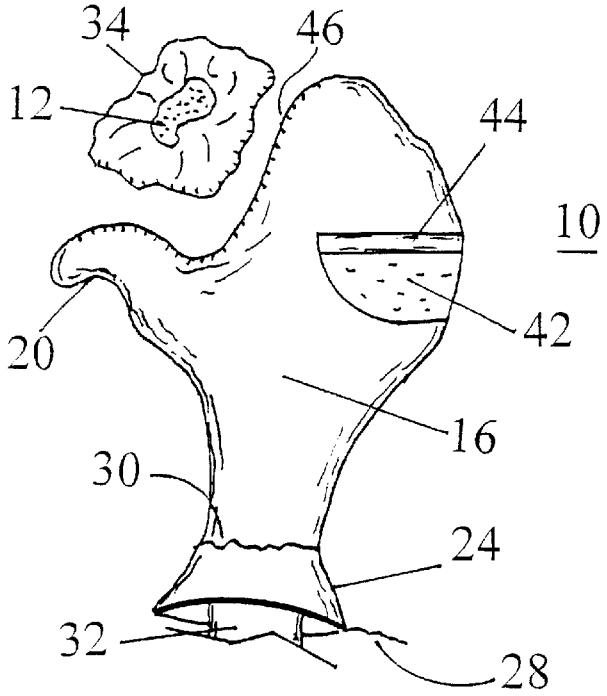
FIG. 5 is an elevational view of the glove-like bag first shown in FIG. 1 illustrating the removal of the offset bag portion with waste material collected therein by use of the perforation-type attachment first shown in FIG. 3.
Figure 6:
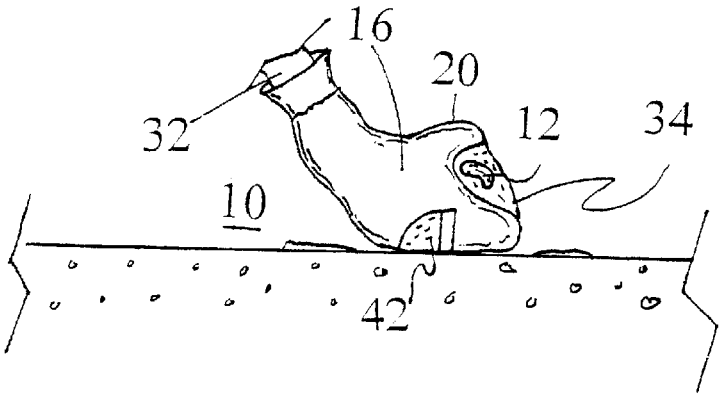
FIG. 6 is a perspective view of the glove-like disposal bag first shown in FIG. 1 illustrating the collection of the waste material in the offset bag portion and the scraping of the surface by the cleaning pad.

As shown in FIGS. 1, 2, and 4–6, the offset bag portion 34 is integrally attached to both the thumb portion 20 and the major body portion 16 along a continuous inner edge 36. When the offset bag portion 34 is disposed on the individual's hand 14 and spread out as shown in FIGS. 1 and 2, an outer edge or ridge 38 is defined that extends along the apex of the offset bag portion 34 from the thumb portion 20 to the major body portion 16. In order to improve the scooping or collecting ability of the offset bag portion 34, a semi-rigid plastic member or reinforcement strip 40 can be affixed to, or embedded within, the offset bag portion 34 along the outer edge 38 as illustrated in FIG. 3.

Illustrated in FIGS. 1–6 are several elements that also enhance the operation of the glove-like bag 10. Secured to the major body portion 16 is a cleaning pad 42 that wraps around the outside part of the major body portion 16. The cleaning pad 42 can serve two purposes: to protect the major body portion 16 from damage and abrasion; and to assist in scraping residual waste material 12 off the respective surface. Also, the glove-like bag 10 can include a sanitizing bar 44 that is attached to the major body portion 16, and which also extends about the outside part of the major body portion 16. The sanitizing bar 44 can be secured to the major body portion 16 adjacent the cleaning pad 42 so that as the surface is being wiped or scraped the sanitizing bar 44 can release or deposit thereon the sanitizing agent or substance. The orientation of the cleaning pad 42 and the sanitizing bar 44 on the major body portion 16 can be varied but it is preferable that the cleaning pad 42 and sanitizing bar 44 extend about the outside part of the major body portion 16 for maximum effectiveness.

The glove-like bag 10 of the preferred embodiment is preferably designed for a one-time use. However, the glove-like bag 10 can be slightly modified to permit repeat use. As shown in FIG. 3, the offset bag portion 34 can be attached to the major body portion 16 and the thumb portion 20 by a perforation member or strip 46 that circumferentially extends about the thumb portion 20. In using the glove-like bag 10 with the perforation member 46, the individual would collect the waste material 12 in the offset bag portion 34 and then carefully remove the offset bag portion 34 along the perforation member 46 thereby allowing the glove-like bag 10 to still be used, for example, as a protective glove when cleaning with caustic solvents and detergents.

Figure 7:
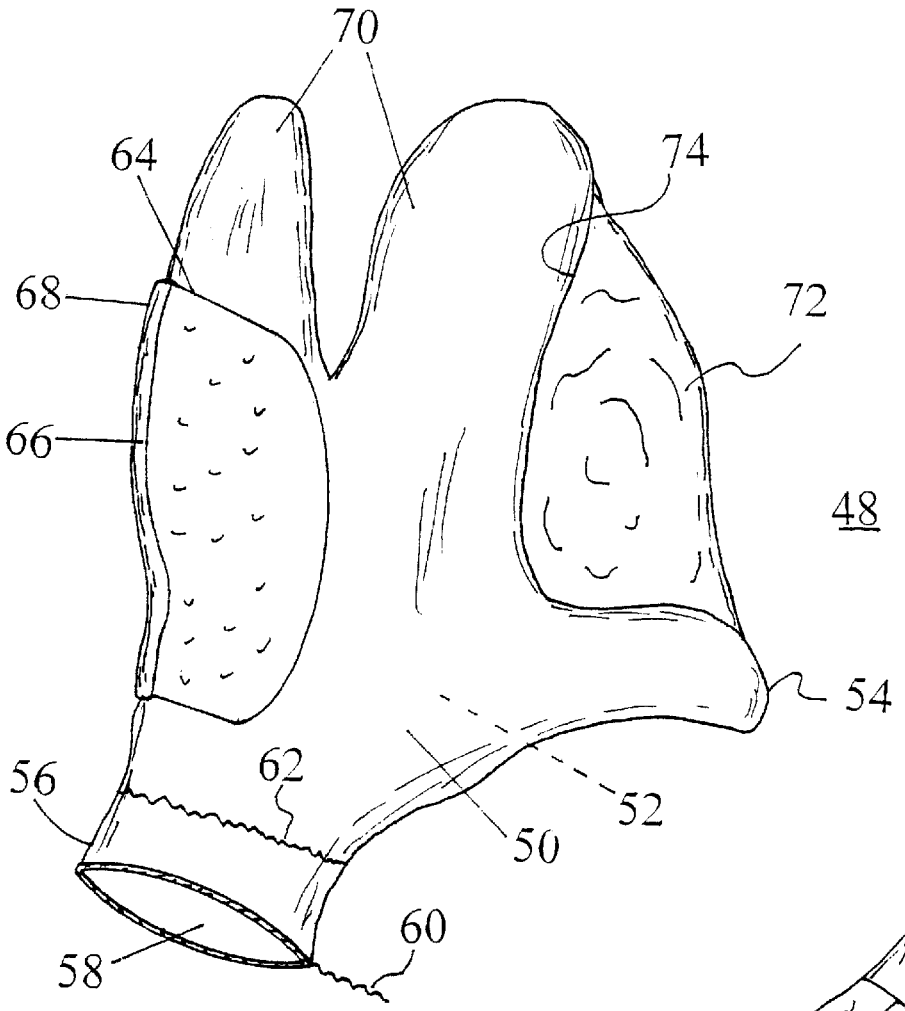
FIG. 7 is a perspective view of an alternate preferred embodiment of the glove-like disposal bag showing the major body portion divided into two finger accommodating portions and an elastic member embedded along the outer edge of the offset bag portion.
Figure 8:
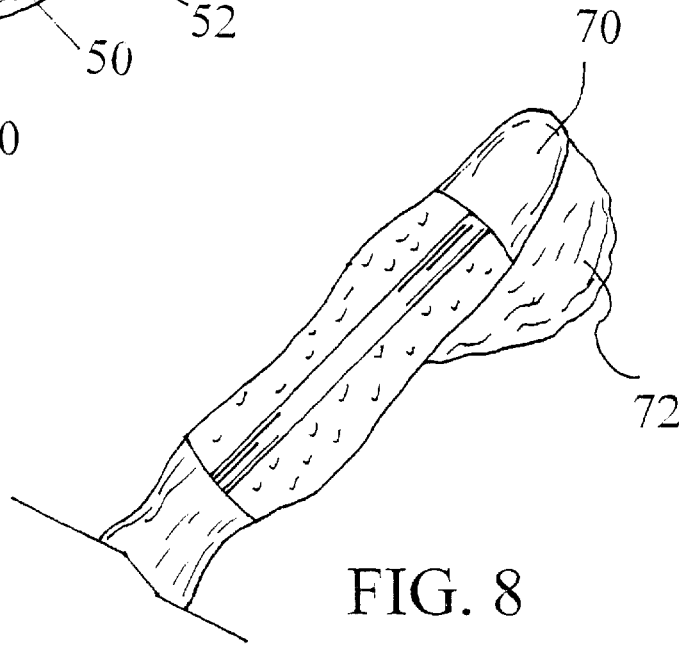
FIG. 8 is a side elevational view of the alternate preferred embodiment of the glove-like disposal bag first shown in FIG. 7.

Illustrated in FIGS. 7 and 8 is an alternate preferred embodiment for the glove-like bag 48 that has many of the elements of the preferred embodiment, but also includes several additional features. The glove-like waste collection and disposal bag 48 of FIGS. 7 and 8 is preferably composed of latex rubber and includes a major body portion 50 having an interior cavity 52 for receiving and comfortably accommodating therein the individual's hand 14, a thumb portion 54 integrally attached to and laterally extending from the major body, portion 50, a slightly flared wrist portion 56 having a hand insertion opening 58 communicating with the interior cavity 52 and through which the hand 14 of the individual is inserted. The glove-like bag 48 of FIGS. 7 and 8 also includes a flexible drawstring 60 attached to or partially embedded within the annular end of the wrist portion 56 and which is tightened upon insertion of the individual's hand 14 within the glove-like bag 48, and a cinched portion 62 which attaches the wrist portion 56 to the major body portion 16 and slightly constricts about the individual's wrist 32 to farther assist in holding the glove-like bag 48 on the hand 14 of the individual. The glove-like bag 48 of FIGS. 7 and 8 further includes a cleaning pad 64 secured to the major body portion 50 and extending about the outside part thereof. A sanitizing bar 66 is attached to the cleaning pad 64, but the sanitizing bar 66 of the alternate embodiment has a longitudinal orientation along the outside edge of the cleaning pad 64. Furthermore, the sanitizing bar 66 is protected by a peel-off member 68 that must be removed in order to release the sanitizing and deodorizing agent or substance.

The glove-like bag 48 of FIGS. 7 and 8 also includes a pair of adjacent and distinct finger receiving portions 70 with one finger receiving portion 70 accommodating therein the individual's little finger and ring finger and the adjacent finger receiving portion 70 accommodating the individuals middle finger and index finger. A pliable offset bag portion 72, also of latex rubber, extends between and is attached to the major body portion 50 and the thumb portion 54. More specifically, the offset bag portion 72 includes an inner edge 74 such that the widening or spreading of the thumb portion 54 from the major body portion 50, and the resulting stretching of the offset bag portion 72, facilitates the collection and holding therein of the waste material 12 because of the natural tendency of the thumb portion 54 to be drawn toward the major body portion 50 thereby further enclosing the waste material 12 within the offset bag portion 72.

While the invention has been described in detail for the preferred forms shown, it will be understood that modifications can be made without departing from the spirit and scope of the appended claims.

We claim:

1. A glove-like bag for collecting waste material from a surface and disposing of the waste material, comprising:

a major body portion having an interior cavity and a laterally extending thumb portion for receiving and accommodating therein an individual's hand;

a flexible offset bag portion attached to and extending between said thumb portion and said major body portion for collecting and holding therein said waste material;

a wrist portion integrally attached to said main body portion and having a hand opening that registers with said interior cavity so that the hand of the individual can pass through said hand opening for placement within said interior cavity;

a cleaning pad disposed on said major body portion opposite of said offset bag portion and extending partially around said major body portion for wiping the surface as the waste material is being collected in said offset bag portion;

a sanitizing bar disposed on said major body portion adjacent to said cleaning pad and extending partially about said major body portion for sanitizing the surface after the waste material has been removed from the surface; and a flexible drawstring secured to said wrist portion and encompassing said hand opening in order to selectively open and close said hand opening for allowing the individual's hand to pass therethrough and for tightening said wrist portion against the individual's hand.

2. The glove-like bag of claim 1 wherein said offset bag portion includes an inner edge for attaching said offset bag portion to said major body portion, and an opposite outer edge.

3. The glove-like bag of claim 2 further comprising a reinforcement strip secured to said outer edge and capable of pliable movement concurrent with movement by said offset bag portion for facilitating the collection of said waste material within said offset bag portion.

4. The glove-like bag of claim 3 further comprising a perforation member for joining said offset bag portion to said major body portion and for permitting selective removal of said offset bag portion from said major body portion so that said waste material collected within said offset bag portion can be disposed of along with said offset bag portion.

5. A glove-like bag for collecting waste material, comprising:

a major body portion having an interior cavity and a laterally extending thumb portion;

a pliable offset bag portion attached to and extending between said thumb portion and said major body portion;

a wrist portion integrally attached to said major body portion and having a hand opening for registering with said interior cavity;

a cleaning pad disposed on said major body portion opposite of said offset bag portion and extending partially around said major body portion; and a sanitizing bar disposed on said major body portion adjacent to said cleaning pad and extending partially around said major body portion.

6. The glove-like bag of claim 5 further comprising a cinch portion conjoining said wrist portion to said major body portion and slightly constricting an area about said wrist portion and said major body portion.

7. The glove-like bag of claim 6 further comprising a flexible drawstring secured to said wrist portion and encompassing said hand opening in order to permit selective opening and closing of said hand opening.

8. The glove-like bag of claim 7 wherein said offset bag portion includes an inner edge for attaching said offset bag portion to said major body portion and an opposite outer edge.

9. The glove-like bag of claim 8 further comprising a reinforcement strip for securement to said outer edge of said offset bag portion and which is capable of concurrent movement with said offset bag portion in order to facilitate collection and disposal of said waste material.

10. The glove-like bag of claim 9 further comprising a perforation member for joining said offset bag portion to said major body portion and for permitting the selective removal of said offset bag portion from said major body portion.

11. A glove-like bag for collecting and removing waste material from a surface, comprising:

a major body portion having an interior cavity into which a hand of a user can be inserted, and a thumb portion extending laterally from the major body portion;

a pliable offset bag portion attached to and extending between said thumb portion and said major body portion for contacting and collecting therein the waste material;

a wrist portion integrally attached to said major body portion and having a hand opening for registering with said interior cavity so that the user's hand can be passed through said hand opening and into said interior cavity;

a cleaning pad disposed on said major body portion opposite of said offset bag portion and extending partially around said major body portion for wiping the surface as the waste material is being collected in said offset bag portion; and a sanitizing bar disposed on said major body portion adjacent to said cleaning pad and extending partially about said major body portion for sanitizing the surface as the waste material is being removed therefrom.

12. The glove-like bag of claim 11 further comprising a flexible drawstring secured to said wrist portion and encompassing said hand opening in order to permit selective opening and closing of said hand opening for facilitating an insertion and removal of the user's hand into and from said interior cavity.

13. The glove-like bag of claim 12 wherein said offset bag portion includes an inner edge for attaching said offset bag portion to said major body portion, and an opposite outer edge.

14. The glove-like bag of claim 13 further comprising a reinforcement strip secured to said outer edge of said offset bag portion and which is capable of pliable movement concurrent with movement of said offset bag portion in order to facilitate collection of the waste material from the surface.

15. The glove-like bag of claim 14 further comprising a perforation member for joining said offset bag portion to said major body portion and for permitting selective removal of said offset bag portion from said major body portion so that the waste material collected within said offset bag portion can be disposed of along with said offset bag portion.

16. A glove-like bag for collecting and removing waste material from a surface, comprising:

a major body portion having an interior cavity for accommodating and enclosing a hand of a user and a laterally extending thumb portion for receiving the user's thumb;

a pliable offset bag portion adjacent to and extending from said major body portion to said thumb portion for contacting and collecting therein the waste material;

a perforation member disposed between and joining said offset bag portion to said major body portion for permitting the selective removal of said offset bag portion from said major body portion so that the waste material that has been collected in said offset bag portion can be disposed of along with said offset bag portion;

a wrist portion attached to said major body portion and having a hand opening for registration with said interior cavity so that the user's hand can be passed through said hand opening for accommodation within said interior cavity;

a cleaning pad disposed on said major body portion opposite of said offset bag portion and extending partially around said major body portion for wiping the surface as the waste material is being collected into said offset bag portion; and a sanitizing bar disposed on said major body portion adjacent to said cleaning pad and extending partially about said major body portion for sanitizing the surface as the waste material is being removed therefrom.

17. The glove-like bag of claim 16 further comprising a flexible drawstring secured to said wrist portion and encompassing said hand opening in order to permit the selective opening and closing of said hand opening so that the user's hand can be inserted into said interior cavity and removed therefrom.

18. The glove-like bag of claim 17 further comprising a reinforcement strip secured to said offset bag portion opposite of said perforation member and which is capable of pliable movement concurrent with said offset bag portion to facilitate the collection of the waste material into said offset bag portion and to increase stability of said offset bag portion while holding the waste material.

* * * * *